US005439741A

United States Patent [19]

Gibbon et al.

[11] Patent Number: 5,439,741

[45] Date of Patent: Aug. 8, 1995

[54] HETEROFILAMENT COMPOSITE YARN

[75] Inventors: John D. Gibbon, Charlotte, N.C.; Stephan F. Sherriff, Rock Hill, S.C.

[73] Assignee: Hoechst Celanese Corporation, Somerville, N.J.

[21] Appl. No.: 285,460

[22] Filed: Aug. 3, 1994

[51] Int. Cl.[6] ..... D02G 3/00

[52] U.S. Cl. ..... 428/377; 428/379; 428/370; 428/373; 57/210; 57/230

[58] Field of Search ..... 428/373, 377, 379, 370; 57/210, 230

[56] References Cited

U.S. PATENT DOCUMENTS

| | | | |
|---|---|---|---|
| 3,645,819 | 2/1972 | Fujii et al. | 156/148 |
| 5,162,153 | 11/1992 | Cooke et al. | 428/373 |
| 5,249,414 | 10/1993 | Iwata | 57/210 |
| 5,318,845 | 6/1994 | Tanaka et al. | 428/373 |
| 5,366,804 | 11/1994 | Dugan | 428/373 |

*Primary Examiner*—N. Edwards
*Attorney, Agent, or Firm*—Philip P. McCann

[57] ABSTRACT

A heterofilament of a PBT sheath, a multifilament composite yarn composed of a plurality of heterofilaments having PBT sheath, and a conductive bundle containing a wire wrapped with a plurality of the multifilament composite yarn.

1 Claim, No Drawings

HETEROFILAMENT COMPOSITE YARN

FIELD OF INVENTION

This invention is directed to heterofilament composite yarns and more particularly relates to such yarns composed of a plurality of heterofilaments, each having a polymeric core component and a sheath component of poly(butylene terephthalate).

BACKGROUND OF THE INVENTION

Yarn in this invention is defined as a continuous strand of textile filament having a number of individual heterofilaments laid together without twist.

Multifilament composite yarns are disclosed in U.S. Pat. No. 3,645,819. Such yarns are characterized as a unit composite having a core component and matrix or sheath component whose melting point is different from that of the core component, and assembling a plurality of the unit composites into a bundle and melting the sheath component forming a composite yarn. Polymeric material used include polyamide, polycaprolactum, polyhexamethylene-adipoamide, polyethylene terephthalate, polypropylene, polyethylene, polyacetal, polyvinyl chloride, polystyrene and copolymers of these polymers. The sheath component is a polyamide polymer. Also, the yarns are characterized as having a rough surface for the prevention of yarn slippage and has voids in the yarn. Such yarns are disclosed for use in tires, in particular, the chafer fabric of tires.

U.S. Pat. No. 5,162,153 discloses a sheath/core bicomponent fiber having a specific poly(butylene terephthalate) copolymer made from dimethyl terephthalate and a blended product of dimethyl adipate, dimethyl glutarate and dimethyl succinate, with butanediol and hexanediol.

The yarns of the present invention are generally used either as monofilament replacements or for use as reinforcement in industrial materials, or in various components of tires. Such uses are predicated on properties of the yarn, in particular for heterofilaments, properties of the core component. Accordingly, there is a need to find a suitable heterofilament composite yarn having a wide variety of properties that may be used in monofilament applications as well as industrial uses and as components in tires.

SUMMARY OF THE INVENTION

This invention is directed to a heterofilament, a multifilament composite yarn and a method to make the multifilament composite yarn.

The heterofilament includes a polymeric core of polyester or polyamide and a sheath component of poly(butylene terephthalate). The multifilament composite yarn includes multiple thermally bonded sheath-core heterofilaments comprising a core component composed of a synthetic polymeric material with a melting point temperature and a sheath polymeric component surrounding the core component. The sheath component consists essentially of poly(butylene terephthalate) polymer having a melting point temperature lower than that of the core polymeric material. The heterofilaments are thermally bonded together to form the multifilament composite yarn.

Detailed Description of the Invention

Heterofilaments are known in the art (e.g., see U.S. Pat. No. Nos. 3,616,183; 3,998,988 and 3,645,819, which are incorporated herein by reference). Heterofilaments are known as "bi-component fibers", "conjugate fibers", "heterofils", or "composite fibers". Heterofilament, as used herein, refers to a filament made from a thermoplastic, synthetic, organic polymer comprised of a relatively high melting polymer core component and a relatively low melting sheath component. Generally, the heterofilaments are either a sheath/core type or a side-by-side type. In either embodiment, both components of the heterofilament will be present in a continuous phase.

The high-melting point polymer core component may have a melting point about 30° C. greater than that of the lower melting point polymer component. Preferably, a sheath/core heterofilament is used, with the core comprising of about 80% of the heterofilament.

The high-melting point polymer core component may be a polyester or a polyamide. The polyester may be polyethylene terephthalate (PET). The polyamide may be nylon-6 or nylon-6,6.

The low-melting point polymer sheath component is polybutylene terephthalate (PBT).

Heterofilaments of the present invention may be spun using the method and apparatus described in U.S. Pat. No. 5,256,050, which is incorporated herein by reference.

In producing heterofilaments having a high-melting point polymer core component of PET and a low-melting point polymer sheath component of PBT, the PET has a typical melting point temperature of 250° C. unless modified to lower the temperature. The melting point of highly crystalline PET is about 270° C. The melting point of PBT depends on its degree of crystallization, ranging from 225° C. to about 235° C.

The composite yarns are formed from a bundle of heterofilaments which are drawn and heated.

Typically, the bundle of heterofilaments is drawn in the range from about 2× to about 6×. Then the yarn is relaxed 2% before winding up. Then the yarn is passed through a heated zone under tension. The temperature in the zone is from about 220° C. to about 320° C.; time is from about 4 sec to about 30 sec; and the amount of tension is about 1 to 2 gpd. Actual conditions are determined by the apparatus and needs of the product. If for example the yarn is passed continuously through an oven the temperature is held high enough to cause the sheath material to fuse and flow. The operating temperature is found by a combination of expertise and trial and error and is dependent on such factors as the denier of the yarn, the velocity of the yarn, the length of the heated zone, and the rate of heat transfer.

Several methods have been used to compress the multifilaments into bonded cords (linear composites).

Method 1: The multifilament yarn is twisted to 1 to 2 turns per inch prior to passing it through the heated zone. In this case no compression device other than tension on the yarn is needed.

Method 2: The yarn (if the yarn denier is not sufficient several yarn bundles can be plied together) is passed through a heated zone as described above. At the exit of the zone the yarn is passed around a set of three free wheeling rolls with grooves cut about 4 cm in diameter and positioned relative to each other about 6 cm apart at the apexes of an equilateral triangle. A typical groove is U shaped and conforms to the dimensions of the bonded cord. However any practical shape is possible depending on the desired cross section of the composite.

Method 3: This method is like method 2 except that the compression device consists of a converging nozzle into which the yarn is fed. The exit hole of the nozzle is the same shape as the desired cross section of the composite and is sized so that the yarn fully fills it and produces a composite with no voids. Note that practical methods of providing a heating zone have been found to be hot air ovens or hot rolls in the case of methods 2 and 3.

The thickness of the heterofilaments of the present invention ranges from about 1 to about 25 denier, and more preferably between 2 and 15 denier. The number of heterofilaments contained within a multifilament yarn is determined according to the requirement of the end use. Typically the thickness of the composite yarn is from about 50 to about 80,000 denier, containing from about 6 to about 26,000 heterofilaments.

General physical properties of the yarn are similar to that of a typical homofil PET yarn. Thus yarns can be produced by those skilled in the art to approximate to any property that can be achieved with PET using an appropriate process. Thus a typical yarn produced by a process route disclosed in U.S. Pat. Nos. 4,101,525 and 4,414,169 would have a tenacity of 8.0 gpd and elongation of 10% and a hot air shrinkage at 175° C. of 8%

Such composite yarns have many uses such as in power transmission belts, chafer fabric for tires, tire cord, and monofilamental applications. Also, the composite yarn may be used in combination with a conductive means such as a wire. In particular, a plurality of composite yarns, 3 for example, may be wrapped around or twisted around a copper wire to create a composite yarn/wire bundle. The bundle is then passed through a heated oven with 1-7% stretch to fuse the yarn into a reinforced sheath encapsulating the wire. This makes a conductive yarn for electrostatic dissipation or for abrasion resistance.

EXAMPLES

Example 1

A heterofilament consisting of polyethyleneterephthalate (PET) in the core and polybutyleneterephthalate (PBT) in the sheath is spun using the heterofil spinning process disclosed in the U.S. Pat. No. 5,256,050. Spinning conditions were set to simulate those that would produce high modulus polyester fibers as described by Davies et al (U.S. Pat. No. 4,101,525) and McClary (U.S. Pat. No. 4,414,169). Thus a 3110 dTex/330 filament yarn was spun at a speed of 1370 mpm with a core composed of 0.92 IV PET and a sheath of 1.00 IV PBT in the ratio of 8:2. The spinning temperature was 300° C. Quench air was applied between 5 cm/sec. These conditions typically give a spun yarn orientation of about 0.03 birefringence. This yarn was drawn in two stages to a total draw ratio of 2.2. The yarn was then passed around a roll at 220° C. and relaxed 2% before winding up to give a final denier of 1280. At this stage the yarn, which still has the appearance of a multifilament, was plied three times and then passed through a heated zone at 460 of for 60 seconds under tension. In that zone a compression device was used to compact the filaments into a monofilament. The device consisted of three free wheeling rolls with grooves cut into them to control the monofil shape. These small diameter rolls (4cm) were positioned at the apex of a equilateral triangle with a side length of 6cm. The following properties were obtained.

| | |
|---|---|
| DTex. | 4577 |
| Tenacity | 6.32 gm/dTex |
| Elongation | 10.9% |
| Initial modulus | 79.5 gm/dTex |
| Hot air shrinkage | 1.48% @ 350° F. |
| Testrite shrinkage | 0.74% @ 0.055 gm/dTex |
| Aspect ratio | 3:1 |

By comparison the properties of the PET monofil obtained under the conditions found to optimize its properties were:

| | |
|---|---|
| DTex. | 4024 |
| Tenacity | 5.69 gm/dTex |
| Elongation | 20.2% |
| Initial modulus | 52.7 gm/dTex |
| Hot air shrinkage | 3.96% @ 350° F. |
| Testrite shrinkage | 1.26% @ 0.055 gm/dTex |
| Aspect ratio | 1.5:1 |

Thus the yarn had 11% better strength, 50% higher modulus, 40% of the shrinkage than the conventional monofil. All these properties directions are desirable for rubber reinforcement. The lateral integrity of the yarn was tested by conducting a rubber peel adhesion test. The yarn was treated by applying a standard tire cord epoxy adhesive followed by an RFL latex at a condition standard for tire cord. The yarn was then vulcanized into a rubber pad and the peels carried out. The peels indicated that the tear failure was all in the rubber and none within the monofil. This indicates very good lateral strength. If the lateral bonding had been poor, the filaments within the yarn would have separated. This is a condition which is sometimes seen in filaments and monofils prone to fibrillation.

Example 2

A heterofil yarn was prepared under the same conditions as given in example 1 except that the PET:PBT ratio was 7:3. The 1000 denier yarn was plied 4 times and fed to a pair of hot rolls set at a temperature of 240° C. at 100 mpm. The rolls were 8" diameter and 8 turns (wraps) of yarn were put on the rolls. The yarn coming off the rolls was fed into a converging nozzle with an exit hole shape like an oval with an L:S ratio of 1.5:1. The yarn was fed from this device to a second pair of cold rolls under a slight tension. From these rolls it was wound up on a bobbin. The resulting composite cord had a smooth appearance similar to a conventional monofil. The tensile properties were tenacity 5.94 gpd, elongation 11.0% and initial modulus 85 gpd. Cross-section of the composite showed an oval shaped cross-section with an L:S ratio of 1:5 and no voids in the structure.

The present invention may be embodied in other specific forms without departing from the spirit or essential attributes thereof and, accordingly, reference should be made to the claims as indicating the scope of the invention.

We claim:

1. A wire reinforced bundle comprising a plurality of multifilament composite yarn twisted around a metallic wire, wherein said multifilament composite yarn comprises thermally bonded sheath-core heterofilaments comprising a core component composed of a synthetic polymeric material having a given melting point temperature and a sheath polymeric component surrounding said core component consisting essentially of poly(-butylene terephthalate) polymer having a melting point temperature lower than said given melting point temperature of said synthetic polymeric material; wherein said sheath-core heterofilaments are thermally bonded together to form a multifilament composite yarn.

* * * * *